United States Patent [19]

Takagi

[11] Patent Number: 5,034,587

[45] Date of Patent: Jul. 23, 1991

[54] APPARATUS FOR HEATING AND COOKING FOOD HAVING A TURNTABLE

[75] Inventor: Minoru Takagi, Aichi, Japan

[73] Assignee: Kabushiki Kaisha Toshiba, Kawasaki, Japan

[21] Appl. No.: 543,369

[22] Filed: Jun. 26, 1990

[30] Foreign Application Priority Data

Jun. 28, 1989 [JP] Japan ..... 1-165629

[51] Int. Cl.[5] ..... H05B 6/78

[52] U.S. Cl. ..... 219/10.55 F; 219/10.55 E; 219/386; 99/443 R; 126/338; 108/20

[58] Field of Search ..... 219/10.55 F, 10.55 E, 219/386, 387; 99/443 R; 126/338; 108/20

[56] References Cited

U.S. PATENT DOCUMENTS

| | | | |
|---|---|---|---|
| 4,036,151 | 7/1977 | Shin | 219/10.55 F |
| 4,629,846 | 12/1986 | Dilyard | 219/10.55 F |
| 4,631,379 | 12/1986 | Aoyama | 219/10.55 F |
| 4,752,662 | 6/1988 | Takagi | 219/10.55 F |
| 4,918,275 | 4/1990 | Okamoto et al. | 219/10.55 F |

FOREIGN PATENT DOCUMENTS

| | | | |
|---|---|---|---|
| 52-29658 | 3/1977 | Japan | 219/10.55 F |

*Primary Examiner*—Philip H. Leung
*Attorney, Agent, or Firm*—Foley & Lardner

[57] ABSTRACT

An improved apparatus for heating and cooking foods includes an oven frame having an interior formed as an oven chamber, a turntable turnably supported on the bottom of the oven chamber, a plurality of rollers rotatably disposed between the turn dish and the outer peripheral region of a bottom plate, and a mechanism which projects downward from the bottom of the turntable which prevents the turntable from sliding on a table surface. The rollers are rotatably received in an annular groove located around the outer peripheral region of the turntable. The mechanism for preventing sliding of the turntable is that of an annular trough having a V-shaped sectional shape. The lowermost part of the annular trough is located lower than the rolling surface for the rollers. In a second embodiment the mechanism for preventing sliding of the turntable is a plurality of downward projections formed around a single circle in an equally spaced relationship.

5 Claims, 3 Drawing Sheets

APPARATUS FOR HEATING AND COOKING FOOD HAVING A TURNTABLE

BACKGROUND OF THE INVENTION

1. Field of the Invention

The present invention relates generally to an apparatus for heating and cooking food. More particularly, the present invention relates to an improvement of the apparatus for heating and cooking food wherein the food is placed on a turntable in an oven chamber.

2. Description of the Background Art

A heating/cooking apparatus of the type including an oven chamber in which a turntable is turnably supported for heating and cooking a food placed thereon by irradiating microwaves toward the food while the turntable turns has been heretofore known.

FIG. 8 illustrates by way of example a conventional apparatus of the foregoing type. The apparatus includes a box-shaped case 1 in which an oven frame 2 is acommodated and supported, and an oven chamber 3 is formed inside of the oven frame 2. The oven frame 2 has an open front end openably and closeably attached to the frame 2 via a door 4. A ceiling plate 2*a* of the oven frame 2 is formed with a microwave output port 5 at a specific position. A microwave guide tube 6 is mounted on the ceiling plate 2*a* to communicate with the microwave output port 5. A magnetron 7 is disposed at the rear end 6*a* of the microwave guide tube 6 in such a manner that an antenna 7*a* of the magnetron 7 projects upward toward the interior of the microwave guide tube 6.

The oven frame 2 has a bottom plate 2*b* which is formed with a circular-dished recess 2*c*. A motor 8 is mounted below the bottom plate 2*b* at the central part of the recess 2*c* for turning a turntable 9. An output shaft 8*a* of the motor 8 is projected upward through the bottom plate 2*b* in the interior of the oven chamber 3. It should be noted that the upper end of the output shaft 8*a* is detachably connected to the turn dish 9 at the central part of the bottom of the latter. In addition, a plurality of rollers 10 are removably arranged between the bottom of the turntable 9 and the bottom plate 2*b*.

When a food W is to be heated and cooked by exciting the magnetron 7, the turntable 9 is turned at a slow speed together with the food W by the motor 8. At the same time, microwaves generated by the magnetron 7 are irradiated toward the food W in the oven chamber 3 via the microwave output port 5 so as to uniformly heat and cook the food W.

However, with the conventional apparatus as constructed in the above-described manner, it has been found that the apparatus has a problem that the bottom plate 2*b* can be cleaned only with much difficulties because the rollers 10 interposed between the turntable 9 and the bottom plate 2*b* obstruct a cleaning operation for cleaning the interior of the oven chamber 3. Another problem is that the rollers 10 themselves are expensive, whereby it is difficult to produce the apparatus at a low cost.

SUMMARY OF THE INVENTION

The present invention has been made with the foregoing problems in mind.

An object of the present invention is to provide an apparatus for heating and cooking a food wherein a bottom plate in an oven chamber can be cleaned easily and completely.

Another object of the present invention is to provide an apparatus for heating and cooking a food wherein the turntable can stably be held on the surface of a table without any possibility of slippage of the turn dish away from the table due to a rolling effect imparted by rollers when the turntable is placed on the table.

To accomplish the above objects, the present invention provides an apparatus for heating and cooking a food, wherein the apparatus includes an oven frame with an interior formed as an oven chamber, a turntable turnably supported on the bottom of the oven chamber, the turntable being capable of turning about a center thereof, a plurality of rollers rotatably arranged below the outer peripheral region of the turntable, and holding means projecting downward of the bottom wall of the turntable, the lowermost end of the holding means being located lower than the rolling surface on which the rollers roll.

According to the present invention, since the holding means is formed to project downward of the rolling surface for the rollers, the turntable can stably be held on the surface of a table without any danger of slippage away from the table due to a rolling effect imparted by the rollers when the turntable is put on the table. The holding means is preferably designed in the form of a V-shaped annular projection which provides a V-shaped groove. This groove serves as a collector for collecting juice derived from a heating/cooking operation, and the rollers are removed from the bottom wall of the oven chamber together with the turntable. Consequently, the oven chamber can be cleaned easily and completely.

Other objects, features and advantages of the present invention will become apparent the following description which has been made with reference to the accompanying drawings.

BRIEF DESCRIPTION OF THE DRAWINGS

The present invention is illustrated in the following drawings in which.

DESCRIPTION OF THE PREFERRED EMBODIMENTS

The present invention will now be described in detail hereinafter with reference to the accompanying drawings which illustrate preferred embodiments thereof.

Figure 1:
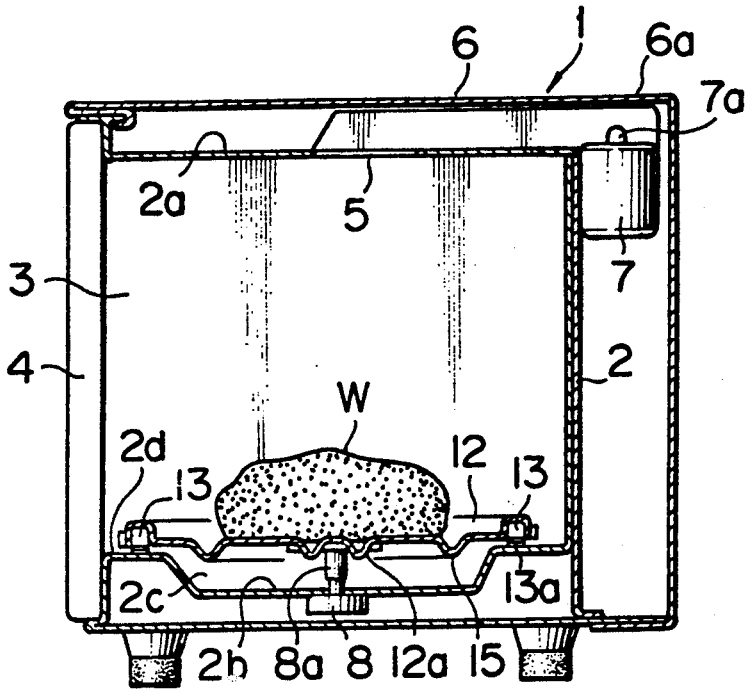
FIG. 1 is a vertical sectional view of an apparatus for heating and cooking a food in accordance with an embodiment of the present invention.

In FIG. 1, reference numeral 1 designates a box-shaped case for a heating/cooking apparatus of the present invention. The case 1 includes an oven frame 2 in which an oven chamber 3 is formed. A door 4 is openably attached to an open front end of the oven frame 2. The oven frame 2 has a ceiling plate 2a in which a microwave output port 5 is formed at a specific position. A microwave guide tube 6 is mounted on the ceiling plate 2a and communicated with the microwave output port 5. A magnetron 7 is disposed at the rear end of the microwave guide tube 6 in such a manner that an antenna 7a thereof is projected upwardly toward the interior of the microwave guide tube 6.

Figure 2:
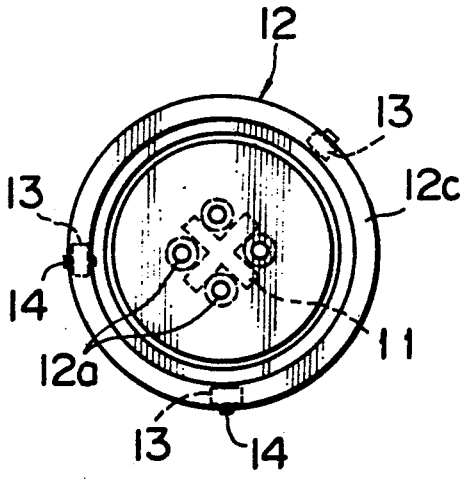
FIG. 2 is a plan view particularly illustrating a turntable in the apparatus in FIG. 1.
Figure 3:
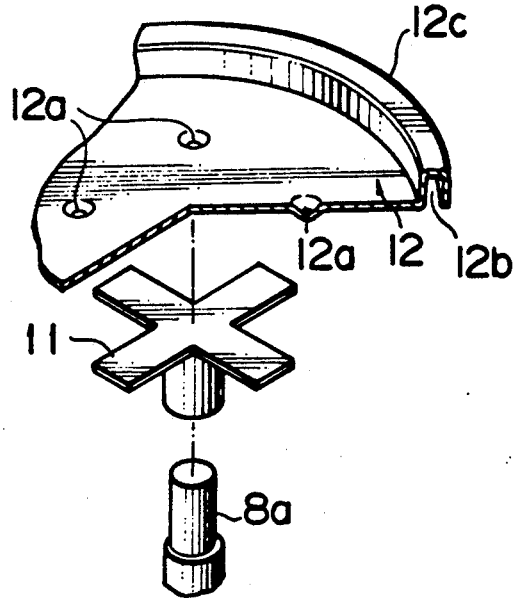
FIG. 3 is an exploded perspective view with a part shown as a fragment in section, particularly illustrating a combination of the turntable and a motor for driving the turntable for the apparatus of the present invention.
Figure 4:
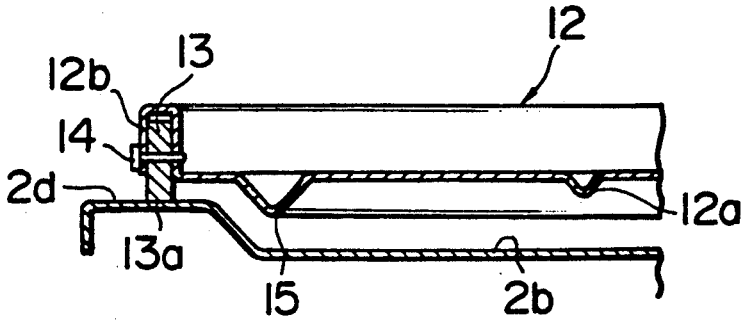
FIG. 4 is a fragmentary sectional view of the turntable in an operative state wherein the turntable is placed in an oven chamber.

In addition, the oven frame 2 has a bottom plate 2b with a circular dish-shaped concavity 2c formed in a substantially central region thereof. A motor 8 is attached to the bottom surface of the concavity 2c and has an output shaft 8a projecting upward in the interior of the oven chamber 3 through the bottom plate 2b. As shown in FIG. 3, a cross-shaped engagement member 11 is fitted onto the upper end of the output shaft 8a. Radially extending parts of the engagement member 11 are secured to the bottom part of a turntable 12 at positions between adjacent dimple-shaped engagement projections 12a each projecting downward of the bottom surface of the turntable 12. The turntable 12 has an annular rim projection 12c around the outer periphery thereof in which a downwardly opened annular groove 12b is formed. As shown in FIG. 2, three rollers 13 are rotatably supported by pin shafts 14 in the annular groove 12b. An annular rolling surface 13a for the rollers 13 is arranged concentrically contiguous to and inside of an annular track 2d on the bottom plate 2b. In addition, an annular trough 15 projecting downward of the rolling surface 13a for the rollers 13 to serve as holding means is formed in the bottom of the turntable 12. It should be noted that the bottom of the annular trough 15 projects downward further in excess of the engagement projections 12a.

That is, the annular trough 15 is formed in the bottom of the turntable 12 and projects downward further in excess of the engagement projections 12a and the rolling surface 13a for the rollers 13.

When a user heats and cooks a food W on the turntable 12 by exciting the magnetron 7, the turntable 12 is turned at a slow speed by the motor 8. As the turntable 12 turns, the rollers 13 roll along the annular track 2d on the bottom plate 2b. At the same time, microwaves generated by the magnetron 7 are irradiated toward the food W on the turntable 12 in the oven chamber 3 via the guide tube 6 and the microwave output port 5 so as to uniformly heat and cook the food W.

Figure 5:
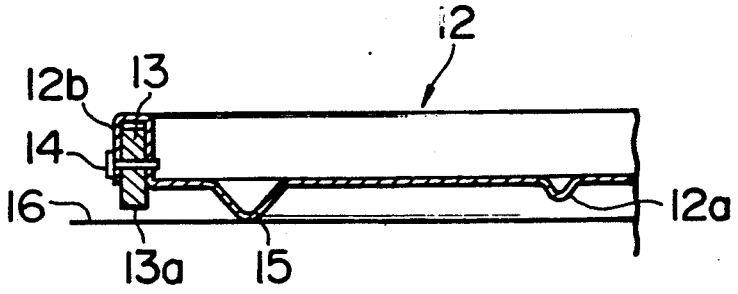
FIG. 5 is a fragmentary sectional view of the turntable in an inoperative state wherein the turntable is put on the surface of a table.

After completion of the heating/cooking operation, the turntable 12 having the foot W placed thereon is taken out of the oven chamber 3 and put on a table surface 16. During this procedure, since the bottom of the annular trough 15 projects downward further in excess of the engagement projections 12a and the rolling surface 13a for the rollers 13 as shown in FIG. 5, the rollers 13 are raised up above the table surface 16. Therefore, the turntable 12 is stably held on the table surface 16 without any possibility of incorrect movement off the table due to rolling of the rollers 13.

Figure 6:
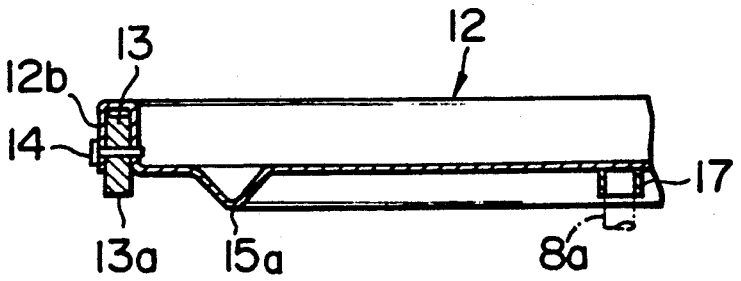
FIG. 6 is a fragmentary sectional view of a turntable for the apparatus in accordance with another embodiment of the present invention.
Figure 7:
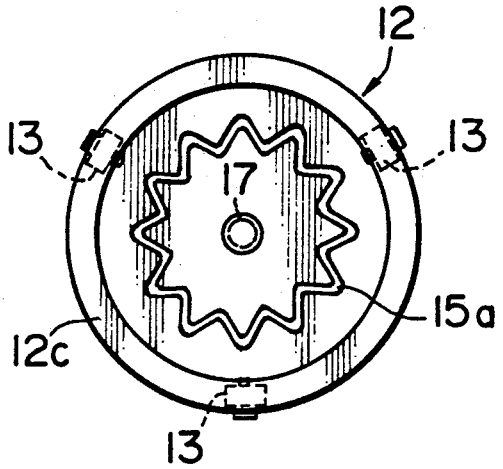
FIG. 7 is a plan view particularly illustrating a turntable for the apparatus in accordance with another embodiment of the present invention.
Figure 8:
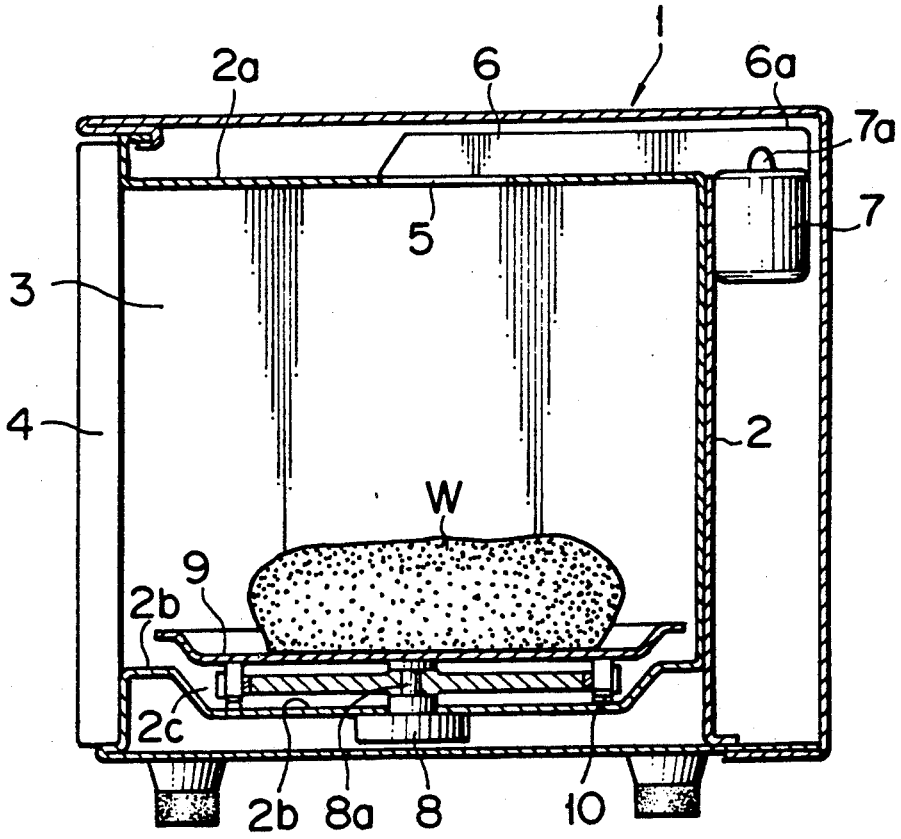
FIG. 8 PRIOR ART
FIG. 8 is a sectional view of a conventional apparatus for heating and cooking foods.

FIGS. 6 and 7 illustrate an apparatus for heating and cooking a food in accordance with another embodiment of the present invention. In this embodiment, a tubular shaft 17 is fixedly secured to the turntable 12 at the central part of its bottom, and the output shaft 8a of the motor 8 is coaxially fitted into the tubular shaft 17. A trough 15a having a circular waveform shape as viewed in a plan view is formed on the bottom of the turntable 12 and projects downward of the rolling surface 13a for the rollers 13. As is apparent from FIG. 7, the trough 15a receives and collects any liquid in the form of a juice oozing out of the food W during heating and cooking.

While the present invention has been described above with respect to a case where the bottom plate 2b of the oven frame 2 has a dish-shaped sectional contour, it should of course be understood that the present invention should not be limited only to this but various changes or modifications may be made without departure from the scope of the invention as defined by the appended claims. For example, the bottom plate 2b of the oven frame 2 may be designed in a flat configuration. In the above-described embodiment, the trough 15 is designed with a downward projecting annular contour. Alternatively, a plurality of downward press-formed projections may be substituted for the annular trough 15.

What is claimed is:

1. An apparatus for heating and cooking foods, comprising:

an oven frame having an interior formed as an oven chamber, a turntable turnably supported in a horizontal plane on a bottom of said oven chamber, said turntable being capable of turning about a center thereof in a horizontal plane while supporting said foods therein, a driving motor for turning a drive shaft, means for detachably coupling said drive shaft to a bottom surface of said turntable, a plurality of rollers rotatably provided below and supporting an outer peripheral region of the turntable, and means for holding said turntable, said holding means projecting downward from the bottom surface of the turntable, a lowermost surface of said means for holding being located lower than the lowest parts of said rollers.

2. The apparatus as claimed in claim 1, wherein said rollers are rotatably mounted in an annular groove which is formed around the outer peripheral region of the turntable.

3. The apparatus as claimed in claim 1, wherein said means for holding comprises an annular trough having a V-shaped sectional shape.

4. The apparatus as claimed in claim 1, wherein said means for holding comprises a serrated annular trough having a V-shaped sectional shape.

5. The apparatus as claimed in claim 1, wherein said means for holding comprises a plurality of downward projections formed around a single circle in an equally spaced relationship.

* * * * *